US005409279A

United States Patent [19]

Magee

[11] Patent Number: 5,409,279

[45] Date of Patent: Apr. 25, 1995

[54] DOG EXCREMENT PICK-UP DEVICE

[76] Inventor: James M. Magee, 18956 E. Mercer Dr., Aurora, Colo. 80013

[21] Appl. No.: 270,263

[22] Filed: Jul. 5, 1994

[51] Int. Cl.[6] ..... A01K 29/00; E01H 1/12

[52] U.S. Cl. ..... 294/1.3

[58] Field of Search ..... 294/1.1, 1.3–1.5, 294/16, 50.8, 93, 97, 118; 15/104.8, 257.1, 257.6; 248/95, 97, 99–101

[56] References Cited

U.S. PATENT DOCUMENTS

| | | | |
|---|---|---|---|
| 1,468,709 | 9/1923 | La Grandeur et al. | 294/1.1 |
| 3,560,039 | 2/1971 | Gruber | 294/1.3 |
| 4,215,887 | 8/1980 | Boots | 294/1.4 |
| 4,323,272 | 4/1982 | Fortier | 294/1.4 |
| 5,186,506 | 2/1993 | Gale | 294/1.3 |

*Primary Examiner*—Johnny D. Cherry
*Attorney, Agent, or Firm*—Charles C. Corbin

[57] ABSTRACT

Disclosed is a tong-like hand implement for collecting solid animal waste within a small plastic bag, including a pair of pivotally connected levers having loop handles at one end. The other ends of the levers support a pair of resilient, bendable, bag-engaging arms that lie parallel to the pivot axis of the levers. These resilient arms are engagable within the open end of a plastic bag, and then the loop handles can be manipulated to space the arms from each other, the arms resiliently bowing as they are spread apart against the open end of the bag, the open bag then being invertible to form a cavity for receiving the waste material, the handles then being manipulated to close the bag about the waste material.

10 Claims, 1 Drawing Sheet

DOG EXCREMENT PICK-UP DEVICE

BACKGROUND OF THE INVENTION

1. Field of the Invention

The present invention relates to devices for collection for disposal of solid excrement of small animals, and more particularly relates to such devices that can support and manipulate a small plastic bag for collection of dog droppings within the bag.

2. Description of the Prior Art

Every day pet dogs will generate collectively speaking, vast quantities of excrement. In higher-density residential environments, where green space is scarce it is increasingly demanded of the dog owner to be responsible for picking up and disposing his pet's droppings for obvious reasons of hygiene and aesthetics. To this end there are governmental laws, ordinances and regulations. Home owner associations and apartment buildings have also adopted rules to ensure the cleanliness of their common areas, walkways and lawn space.

Accordingly, there has developed a need for a clean, hygienic and convenient way to collect and dispose of dog droppings. The earlier approach to the problem took the form of implements such as shown in U.S. Pat. No. 3,560,039 to Gruber, which had a tong-like construction with handles at one end and scoop portions at the other. Although it was recommended in Gruber, that a piece of tissue paper be draped over the excrement prior to picking it up, in order to minimize soiling of the tool, the problem of soiling the device could be avoided only with great care, and frequent washing of the tool was required. The advent of inexpensive disposable plastic bags made possible cleaner and more convenient collection of pet droppings via the development of implements that could support and manipulate a bag for collection within the bag. Thus UK Patent 2,115,737, and U.S. Pat. No. 5,186,506, 4,215 887 and 3,813,121, all show implements including pivotally connected members having jaws over which a plastic bag can be engaged. In general these prior art devices and similar types all have certain drawbacks regarding the manner of supporting the plastic bag so that it can envelope and collect the deposited excrement in the most effective manner. For example, the devices of the aforementioned prior art all use rigid bag-engaging structures that appear to be limited in their ability to use bags of different sizes, and in the ability to control and adjust the shape of the open mouth of the bag. It is also noted that with such devices the jaws must be moved to a fully open position in order to properly tension the-bag open, such rigid jaws tending to loosen their grip on the bag during their movement to and from their fully extended positions.

U.S. Pat. No. 4,225,169 represents a departure from the aforementioned devices by employing a mechanical hand comprised of multiple resilient fingers over which a bag is mounted. Unfortunately, such designs lack simplicity and tend to be relatively expensive to make, and furthermore require the use of two hands.

SUMMARY OF THE INVENTION

In view of the foregoing, it is a general object of the present invention to provide an implement with enhanced ability to support and manipulate a plastic bag for collection and disposal of animal waste.

A more specific object is to provide such a device that grips a plastic bag with a tensioning force no matter how open the bag is held.

A further object is to provide such a device that can handle a variety of sizes of plastic bags.

A still further object is to provide such a device that can resiliently conform the mouth of a plastic bag to a shape that is most effective for accommodating a given shape and size of the dog droppings.

These, and other objects and advantages are achievable by the present invention of a device for the collection of solid dog waste within a plastic bag, the device including a pair of pivotally connected tong-like elongated members, each member having a front end and a rear end, and a loop handle at the rear end of each tong-like member.

At the front end of each tong-like member is secured a resiliently bowable, bag-engaging arm that lies parallel to the pivot axis of the members. In a preferred embodiment of the invention, the arms take the form of resilient, generally flat strips, and the device has a first position when the loop handles are brought together to cause the resilient strips to engage each other along their front edges, in which position the strips are inclined at about 90° to each other. This inclination provides the resilient strips with sufficient rigidity to allow them to function as scooping ramps for gathering of waste material when they are moved towards each other from a separated position in which the arms are separated.

The arms are adapted for insertion within the open end of the flexible plastic bag, the handles then being movable to cause the arms to separate and grip inside surfaces of the bag, which then causes them to resiliently bend to hold open the mouth of the open end of the bag. The closed end of the bag can then be pushed inwardly of the spread-apart arms, to invert the bag, and to form a cavity within the bag for receiving waste material, The size and shape of the waste-receiving opening thusly formed will then vary according to the extent of separation of the arms. In one embodiment of the invention, the outside of the resilient arms are provided with bag engaging projections that enhance the ability of the arms to grip the plastic material of the bag.

DETAILED DESCRIPTION OF THE INVENTION

Figure 1:
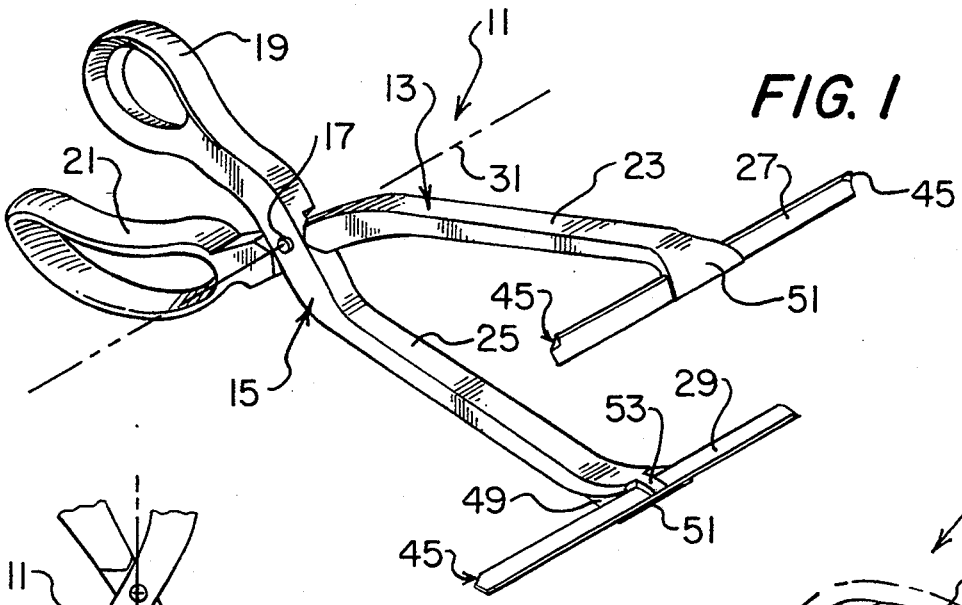
FIG. 1 is a perspective view of a preferred embodiment of a device according to the present invention.

Referring now to the drawings, FIG. 1 shows that a preferred embodiment of a device 11 for picking up dog excrement, has a tong-like construction that has a first member 13 that is pivotally connected to a second member 15 using a suitable connecting pin 17. The rear ends of members 13 and 15 have loop handles 19 and 21, the loop handle 19 preferably designed to comfortably receive the thumb of a user, and the elongated loop 21 designed for receiving the user's index and two adjoining fingers, for maximum control in manipulating device 11, and comfort.

Novel aspects of the present invention are seen to lie in the forward portion of device 11, which include elongated levers 23 and 25, and which features resilient bag-engaging arms 27 and 29 that are affixed respectively to the ends of arms 23 and 25.

Figure 2:
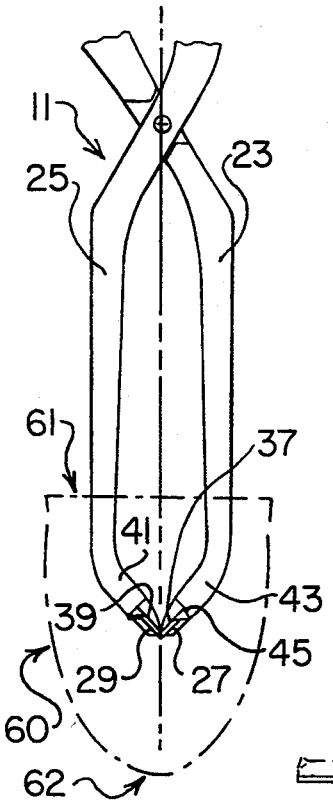
FIG. 2 is a partial side elevational view illustrating the forward portion of a device according to the present invention.
Figure 3:
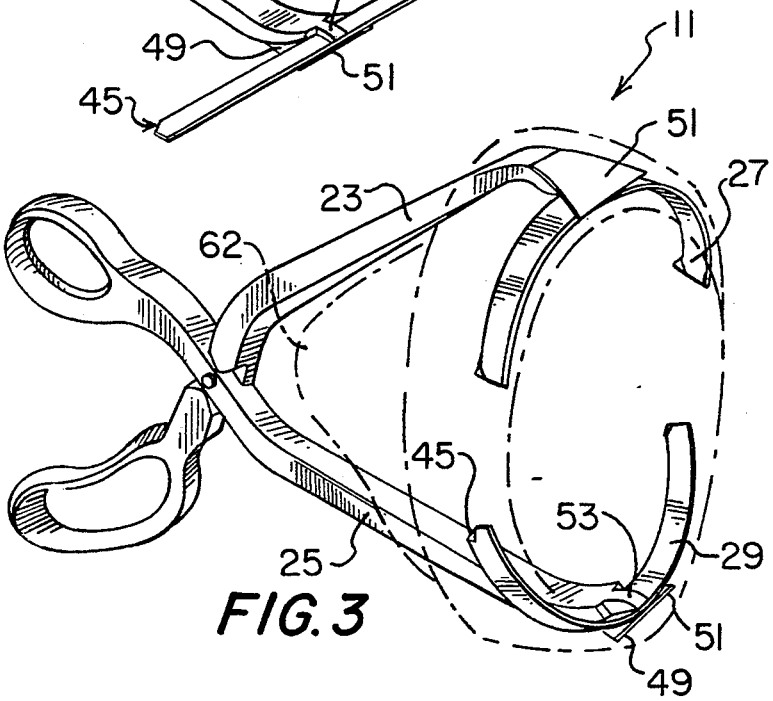
FIG. 3 is a perspective view illustrating the use of the device of FIG. 1 in conjunction with a plastic bag.
Figure 4:
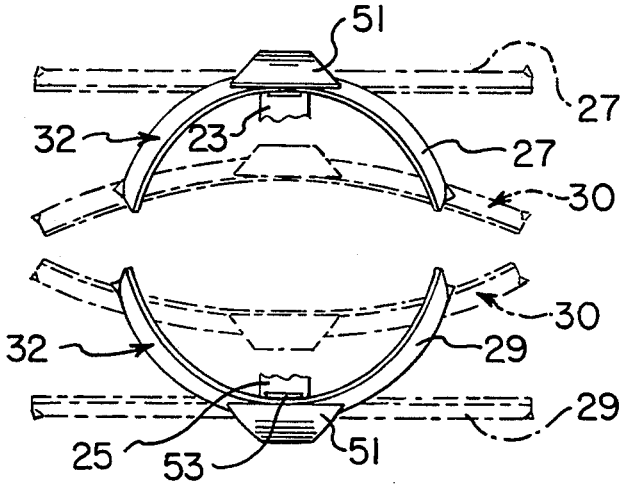
FIG. 4 is a front elevational view of the device, illustrating operation of the bag-engaging arms of the device.

As best shown in FIGS. 1, 3 and 4, the bag-engaging arms 27 and 29 comprise flat strips of resilient material, made of a suitable plastic or a springy metallic material, or a composite material, and extend parallel to the pivot axis 31 of members 13 and 15. The forwardmost ends of levers 23 and 25 are provided with slots in which the resilient arms 27 and 29 are secured using a suitable adhesive or a fastener. For example, as FIGS. 1 and 3 suggest, the arm 29 is engaged in a slot that is formed between a surface 49 of a support head 51, to be described, and the undersurface of a support ledge 53. Note that when the device 11 is in the position illustrated in FIG. 2, outer edges of arms 27 and 29 touch each other as illustrated, and respective inner surfaces 37 and 39 of arms 27 and 29 will be seen to serve as scooping surfaces which are inclined to each other at an angle of about 90°, and note that when device 11 is in the position illustrated in FIG. 2 the inclination of end portions 41 and 43 of the levers 23 and 25 assure that there is a significant spacing between levers 23 and 25, which will be seen to be sufficient to accommodate a plastic bag containing a mass of waste material, when device 11 is used for its intended purpose as will be described hereinafter. At opposite ends of each arm 27 and 29 are provided outwardly pointed tips 45 which are intended to enhance the ability of arms 27 and 29 to make gripping engagement with a plastic bag.

In some variants of the invention, not shown, projections of rubber-like, non-slip material are used instead of the tips 45, and in other instances it is contemplated that the entire arms 27 and 29 comprise a polymeric material that tends to grip rather than slip when engaged with the material of a conventional plastic bag.

FIGS. 1 and 3 best show the preferred way in which the resilient arms 27 and 29 are supported at the end of levers 23 and 25; note how the member 29 is embraced between the under surface 49 of a relatively broad, non-resilient support head 51, and a relatively narrow support ledge 53, such that arm 29 can be resiliently bowed upwardly about the narrow ledge 53 as shown. When the bowed arm 29 is released, it will spring back to its straight configuration and will abut the undersurface 49 of the support head 51 so as to lend rigidity to the arm 29 to hold it against bowing in the downward direction as viewed in FIG. 4.

Note that the other arm 27 is supported in a similar fashion to the arm 29, such that it can be resiliently bowed downwardly, as viewed in FIGS. 3 and 4.

Having described the structure of device 11, its use and operation as an implement for gathering animal waste can now be described with reference to FIGS. 2, 3 and 4. Device 11 is used in conjunction with a conventional, inexpensive, disposable plastic bag 60 that has an open end 61 and closed end 62, and the forward end of device 11 can be partially inserted within the bag 60 as FIG. 2 illustrates, with arms 27 and 29 positioned just inside the open end 61 of the bag. Then the handles 19 and 21 can be moved apart to cause the outer surfaces of arms 27 and 29 to engage, grip, and be tensioned against inside surfaces of bag 60. This will cause bowing of arms 27 and 29. The more that levers 23 and 25 are spread, the greater the arms 27 and 29 will be caused to bow, and FIG. 4 illustrates in phantom lines at 30 a relatively small amount of bowing that occurs during initial separation of the device levers, and the generally circular configuration at 32 that is formed when they are fully spread apart. It should be appreciated that because of the resilient nature of arms 27 and 29, these arms remain tensioned against the bag throughout the arm spreading process, engagement of the tips 45 helping to maintain a grip upon the plastic material. When the device is configured as shown in FIG. 3, the closed end 62 of the bag can be pushed inwardly to an inverted position as illustrated, thus forming a pocket in which a mass of animal excrement is to be received. Although the mouth of the bag is shown held in a generally circular configuration in FIG. 3, it should be appreciated that since arms 25 and 27 remain tensioned against the bag material throughout the opening and closing of the bag mouth, the bag mouth will vary in configuration as the arms are moved closer to each other, from the circular through the oblong shape indicated by reference numeral 30. This feature of the invention enhances the ability of the device 11 to effectively encircle the mouth of the bag over a mass of dog waste of various shapes and sizes. With device 11 held in an inverted position, the targeted droppings are encircled by the open mouth of the bag. Then, with the arms engaging the ground, the handles can be drawn together to move arms 27 and 29 together, whereby the inclined surfaces 37 and 39 will tend to gather or scoop the waste material into the bag. The filled bag can be discarded in a sanitary, convenient fashion.

Although a specific preferred embodiment of the invention has been described, it will occur to those of ordinary skill in the art that various changes can be made without departing from the invention. Thus, it is intended to include all such variants that fall within the full scope and breath of the invention as set forth in the following claims.

What is claimed is:

1. Device for the collection of solid animal waste within a small plastic bag having an open end and a closed end, said device including:

a. a pair of tong-like elongated members, each member having a front end and a rear end;

b. means for pivotally connecting said tong-like members intermediate their respective ends;

c. a loop handle at the rear end of each tong-like member; and d. transverse bag-engaging resiliently bowable arms parallel to the pivot axis of said connecting means, each of said arms having opposite ends and affixed to the front end of one of said tong-like members intermediate said opposite ends, whereby said device has a first position when said handles are brought together to cause said arms to engage each other, said device movable from said first position to a second position in which said arms are separated, said arms being adapted for insertion within the open end of said bag whereby said device is movable to its second position to cause said arms to grip inside surfaces of said bag and to resiliently bend to hold open the open end of said bag, the closed end of said bag then to be pushed within said bent arms to form a cavity in said bag for receiving said waste.

2. A device as defined in claim 1 including a bag-gripping projection at the opposite ends of each of said arms.

3. A device as defined in claim 2 wherein said bag-gripping projection is comprised of a polymeric material that provides a surface that is non-slip with respect to said plastic bag.

4. A device as defined in claim 2 wherein said projection has a bag-engaging tip.

5. A device as defined in claim 4 wherein each of said arms have the configuration of a generally flat strip.

6. A device as defined in claim 4 wherein said tips are pointed.

7. A device as defined in claim 1 wherein said arms are made of polymeric material that is non-slip with respect to said plastic bag.

8. A device as defined in claim 1 wherein each said arm comprises a relatively flat strip of resilient material.

9. A device as defined in claim 1 wherein each said arm is a generally flat resilient strip with an inner surface and an outer surface, and when said device is in its first position, said respective inner surfaces lie at an angle with each other in the range of about 45° to 90°.

10. A device as defined in claim 9 wherein said respective arm inner surfaces form waste-gathering scoops that are inclined to each other at about 90° when said device is in its first position.

* * * * *